United States Patent [19]

Mennesson

[11] 4,172,436

[45] Oct. 30, 1979

[54] CARBURATION DEVICES FOR INTERNAL COMBUSTION ENGINES

[75] Inventor: Andre L. Mennesson, Neuilly-sur-Seine, France

[73] Assignee: Societe Industrielle de Brevets et d'Etudes S.I.B.E., France

[21] Appl. No.: 735,732

[22] Filed: Oct. 26, 1976

[30] Foreign Application Priority Data

| | | | |
|---|---|---|---|
| Oct. 31, 1975 | [FR] | France | 75 33410 |
| Jan. 2, 1976 | [FR] | France | 76 00025 |
| Jan. 16, 1976 | [FR] | France | 76 01179 |

[51] Int. Cl.[2] ..... F02M 7/14

[52] U.S. Cl. ..... 123/119 EC

[58] Field of Search .... 123/119 EC, 119 R, 139 AW, 123/32 EE, 32 EB; 261/50 A, 23 A

[56] References Cited

U.S. PATENT DOCUMENTS

| | | | |
|---|---|---|---|
| 2,876,758 | 3/1959 | Armstrong | 123/139 AW |
| 3,596,645 | 8/1971 | Mennesson | 123/139 AW |
| 3,650,258 | 3/1972 | Jackson | 123/139 AW |
| 3,713,630 | 1/1973 | Laprade et al. | 261/50 A |
| 3,963,002 | 6/1976 | Sueishi et al. | 123/32 EE |
| 4,034,721 | 7/1977 | Lenzi et al. | 123/139 AW |
| 4,046,121 | 9/1977 | Pierlot | 123/139 AW |

FOREIGN PATENT DOCUMENTS

| | | |
|---|---|---|
| 1410210 | 8/1965 | France. |
| 1035640 | 7/1966 | United Kingdom. |

*Primary Examiner*—Charles T. Jordan

*Attorney, Agent, or Firm*—Stevens, Davis, Miller & Mosher

[57] ABSTRACT

A carburettor for an internal combustion engine comprises an air valve and a driver-actuatable throttle in an induction pipe. The air valve controls proportioning means metering the flow rate of fuel drawn into the induction pipe downstream of the main throttle means via a discharge orifice. A fuel pressure regulator is disposed between the fuel proportioning means and the discharge orifice for controlling the pressure of the fuel discharged into the induction pipe and comprises a valve actuated by a diaphragm one face of which limits a control chamber communicated with that portion of the induction pipe located between the throttle and the air valve. The other surface is subjected to the fuel pressure prevailing upstream of the valve.

21 Claims, 13 Drawing Figures

25
18
R
24
23
26
19
22
32
37
25
2
7
13
10
17
16
15
18
5
4
3
14
11
6
8
12
1
9
27
N
20
13

CARBURATION DEVICES FOR INTERNAL COMBUSTION ENGINES

The invention relates to carburation devices for internal combustion engines comprising, in an induction pipe, auxiliary throttle means which is located upstream of driver-actuatable main throttle means, opens automatically and progressively in proportion to the increase in the flow rate of air through the pipe, and controls proportioning means metering the flow rate of fuel drawn into the induction pipe downstream of the main throttle means via a discharge orifice.

It is known that the pressure of the fuel downstream of the proportioning means should be controlled for accurately metering the fuel flow. In the past, this has generally been done by drawing the fuel into the section of the induction pipe part upstream of the main throttle means. However, such a construction has drawbacks which have been overcome (U.S. Pat. No. 3,259,378) by delivering fuel downstream of the main throttle means across a chamber at the same pressure as the said section. On the other hand, this requires a passage having a large cross-sectional area and which continuously supplies air to the induction pipe downstream of the main throttle means. Due to its large cross-section, the passage has an unfavourable effect on idling. If the fuel discharge orifice is given a sufficient flow cross-section to provide the flow rate necessary for engine operation at full load, it is excessive for the flow rate during idling. This results in irregularity in the flow on idling. For these reasons, operation is not entirely satisfactory at very low loads and speed.

It is an object of the invention to provide an improved carburation device of the above-defined type. To this end, there is provided a carburation device having a fuel pressure regulator disposed between the fuel proportioning means and the discharge orifice for controlling the pressure of the fuel discharged into the induction pipe and which comprises valve means actuated by a diaphragm one face of which limits a control chamber communicated with that portion of the induction pipe located between the auxiliary throttle means and the main throttle means. The other surface is typically subjected to the fuel pressure prevailing upstream of the valve means.

In a particular embodiment of the invention, the air pressure which prevails between the main and auxiliary throttle means is communicated to the control chamber, whereby the fuel pressure is maintained approximately equal to the air pressure between the main and auxiliary throttle means. Then the fuel pressure differential across the fuel proportioning means is the same as if the fuel were drawn into the induction pipe between the throttle means and accurate fuel metering is achieved.

In another embodiment, the control chamber is provided with means for modulating the air pressure therein as a function of at least one engine operating parameter.

The parameter can be external to the engine, e.g. the pressure or temperature of the ambient air, which is not influenced by modifications in the flow rate of drawn fuel. Alternatively, the parameter can be influenced by modifications in the flow rate of drawn fuel, in which case the device becomes a "looped" or servo system. The composition of the engine exhaust gases is an example of such a parameter.

The modulating means may comprise a solenoid controlled valve connecting a passage provided between the control chamber and the portion of the intake pipe between the auxiliary and main throttle means to a region at or near atmospheric pressure. Means sensitive to the aforementioned operating parameter supplies the electromagnetic control valve with periodic electric pulses having a cyclic ratio which depends on the aforementioned parameter.

The frequency at which the control pulses are transmitted must be sufficient to avoid pressure oscillations at the same frequency in the control chamber.

It may be advisable to design the device for preventing undesirable opening of the fuel pressure regulator valve upon tilting of the vehicle, while using a return spring of moderate force and for obviating the effects of an abrupt opening of the main throttle means. For that purpose, air may be supplied via a calibrated orifice to the chamber receiving the fuel before said fuel flows through a regulator valve and fuel may be supplied to the pressure regulator in the immediate neighbourhood of the regulator.

The pressure regulator may be disposed so that the valve is at a lower level that the fuel and air supplies. In practice, it is usually advantageous to arrange the or each pressure regulator vertically, the orifice controlled by the valve opening downwards, fuel being supplied immediately above the valve and air being supplied at the top part of the chamber bounded by the orifice and the movable components of the valve, controlled by the pressure between the throttle means. The same proportioning means and pressure regulator can be provided for all cylinders of the engine; alternatively individual proportioning means and/or individual pressure regulators can be provided for each group of engine cylinders or for each cylinder. The latter feature may usually be considered more satisfactory, since a discharge orifice is provided for each cylinder and the fuel is better distributed to the cylinders.

The proportioning means may comprise a tube whose wall is formed with a slot perpendicular to the tube axis and a closure member received in the tube and operatively connected to the auxiliary throttle means for sliding movement along said axis responsive to opening movement of said throttle means, said closure member having an oblique end surface constructed to close a fraction of said slot which depends on the axial position of the closure member. The slot may be formed between two tubular elements secured in end-to-end relation and constituting the tube, the terminal portion of one at least of the elements being appropriately cut, for instance by milling.

There may be provided an individual proportioning means for each cylinder of the engine. Typically, individual proportioning means will be provided for each pair of cylinders. Then the tube will be formed with two diametrically opposite slots cooperating with the same closure member and each associated with one cylinder. That manual adjustment may be made by modifying the angular position of the closure member.

The invention will be better understood from the following description of carburation devices constituting embodiments thereof, given by way of non-limitative examples. The description refers to the accompanying drawings, in which:

FIG. 1 is a schematic elevational view, partly cut away, of the main components of a carburation device for a four-cylinder engine;

FIG. 2, similar to part of FIG. 1, shows a modified embodiment;

FIG. 3 is a view in section along line III—III of FIG. 2;

FIG. 4, which is similar to FIG. 1, shows another embodiment;

Figure 1:
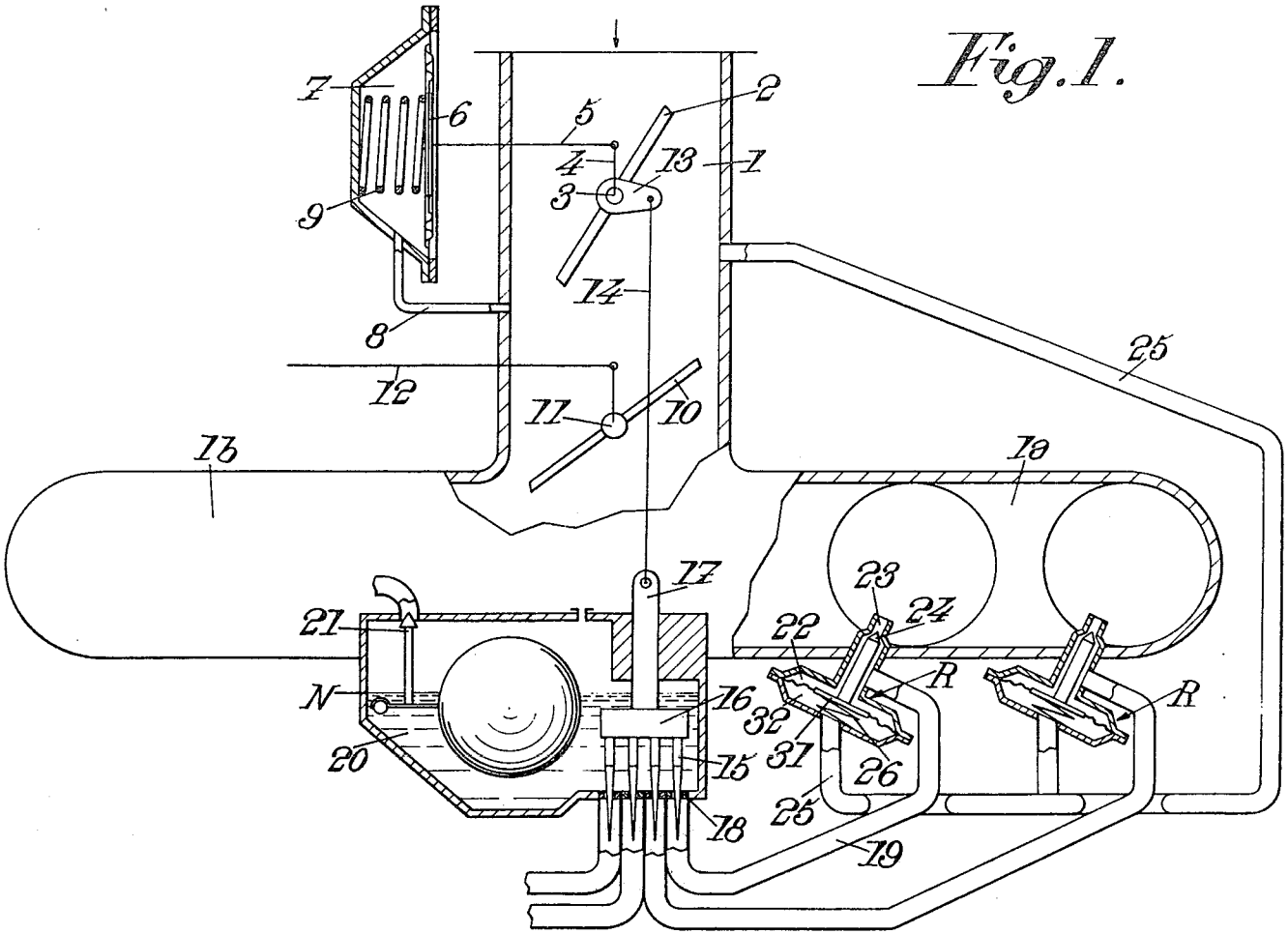
Figure 8:
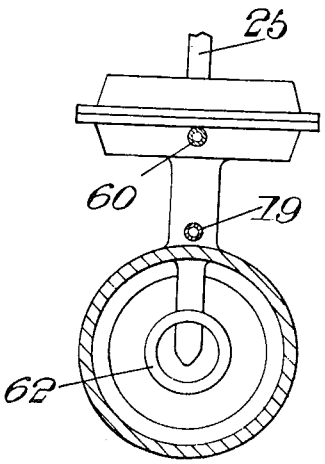
Figure 7:
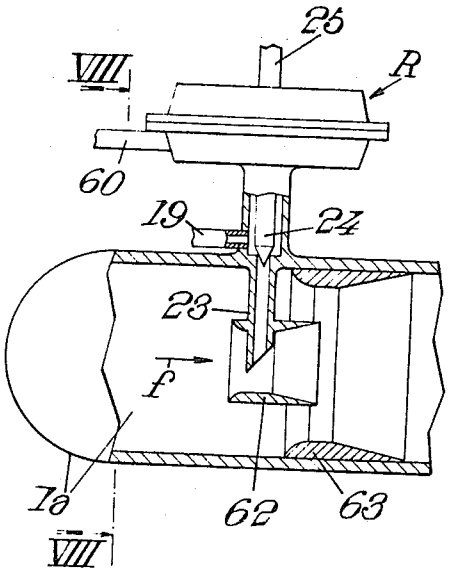
Figures 9, 10, 11, 12, 13:
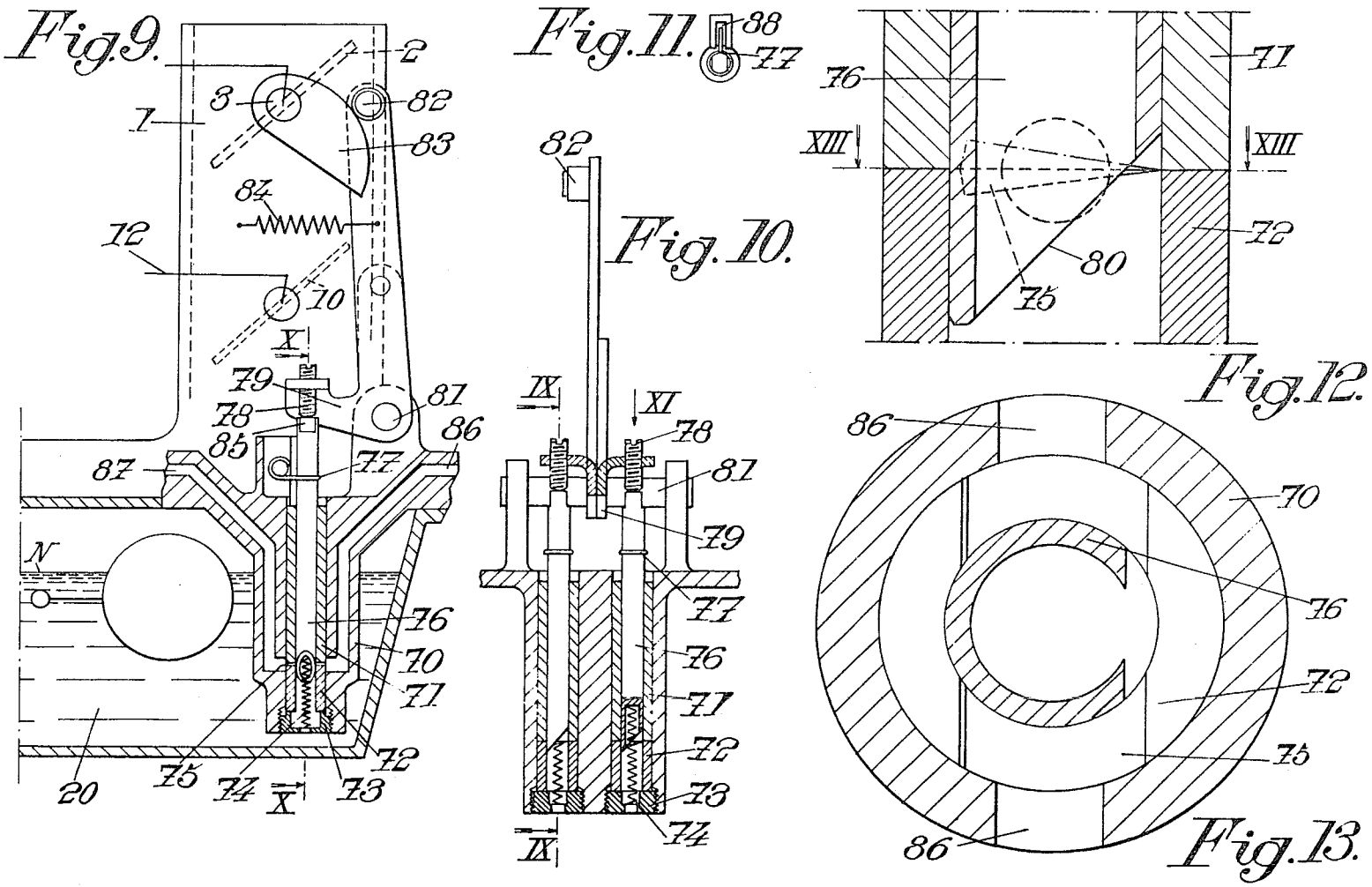

FIG. 7, similar to part of the diagram in FIG. 1, shows another modified embodiment;

FIG. 8 is a view in section along line VIII—VIII of FIG. 7;

FIG. 9 is a schematic view showing the main components of part of another embodiment, in cross-section along line IX—IX in FIG. 10;

FIG. 10 is a cross-sectional view along line X—X in FIG. 9;

FIG. 11 is a detail view, as shown in the direction of arrow XI in FIG. 10;

FIG. 12 is an enlarged view in cross-section along the same vertical plane as FIG. 11 and shows a metering slot;

FIG. 13 is a cross-sectional view along line XIII—XIII in FIG. 12.

Referring first to FIG. 1, which shows only those components of the device which are necessary for understanding the invention, the carburation device has an induction pipe 1 which divides into two branches 1*a*, 1*b* which supply the four engine cylinders via pipes indicated by circles. Auxiliary throttle means 2 comprising a balanced butterfly valve mounted on a rotatable shaft 3 and main throttle means 10 (means 2 and 10 being disposed in that order in the direction of air flow) are disposed in the induction pipe. Shaft 3 is connected by a lever 4 and link 5 to a diaphragm 6 forming a movable wall of a compartment 7 connected to the induction pipe 1 by a passage 8 opening betwen means 2 and 10. A spring 9 disposed between diaphragm 6 and the end wall of compartment 7 exerts a force tending to close the auxiliary throttle means 2.

The main throttle means comprises a butterfly 10 mounted on a shaft 11 operatively connected to a linkage 12 which is actuated by the driver or any control system such as a speed regulator, servocontrol system, etc.

The opening angle of the auxiliary throttle means 2 is a measure of the flow rate of air in the intake pipe 1; in operation there prevails in the portion of pipe 1 between means 2 and means 10 a depression which increases slightly with the flow rate.

The auxiliary throttle means 2 can be of a type different from that shown in FIG. 1. For instance it can be an eccentric butterfly valve associated or not with a pneumatic capsule and which the flow of air through pipe 1 tends to open against the action of a spring which tends to close it. Alternatively, means 2 can be a slide valve reciprocable in a direction transverse to pipe 1, as disclosed for instance in U.S. Pat. No. 3,259,378 (Mennesson).

The auxiliary throttle means 2 actuates a proportioning means which meters the flow rate of fuel discharged into the engine. Referring to FIG. 1, the proportioning means comprises a set of four identical needles 15 having a suitable cross-section and secured to a holder 16 which is reciprocable by a rod 17 in the longitudinal direction of the needles. Rod 17 is connected by a rod 14 and a lever 13 to the shaft 3 of the auxiliary throttle means 2, so that opening movement of means 2 drives needles 15 in a direction which tends to increase the area available for fuel flow between needles 15 and the wall of corresponding jets or orifices 18 formed in a stationary plate around the rods. Each orifice 18 communicates a duct 19 to a float chamber 20 in which the fuel is maintained at a constant level N by a supply system 21 comprising a float and a float spindle. In the embodiment illustrated, one supply duct 19 is provided for each engine cylinder but this is not essential.

Each duct 19 opens into a fuel pressure regulator R comprising a casing made up of two shells which clips the peripheral portion of a movable diaphragm 31. In the regulator casing, diaphragm 31 separates two chambers 22 and 32. Chamber 22 communicates with duct 19 and has a discharge orifice 23 opening into a respective branch of the intake pipe 1, associated with one of the cylinders. The wall of discharge orifice 23 constitutes the seat of a valve member 24 secured to diaphragm 31. The control chamber 32 communicates via a passage 25 with the part of the intake pipe 1 between throttle means 2 and 10. A spring 26 is typically disposed to exert on diaphragm 31 a force which applies valve member 24 onto its seat when the engine stops and which balances the weight of the movable components of the regulator.

Figure 3:
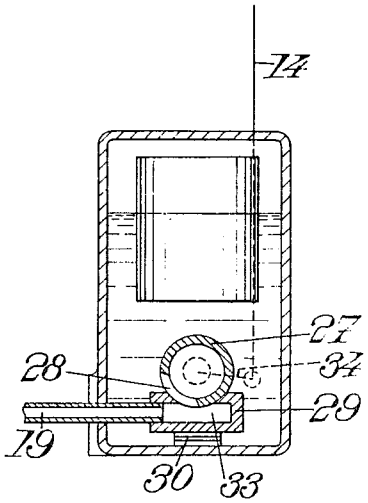
Figure 2:
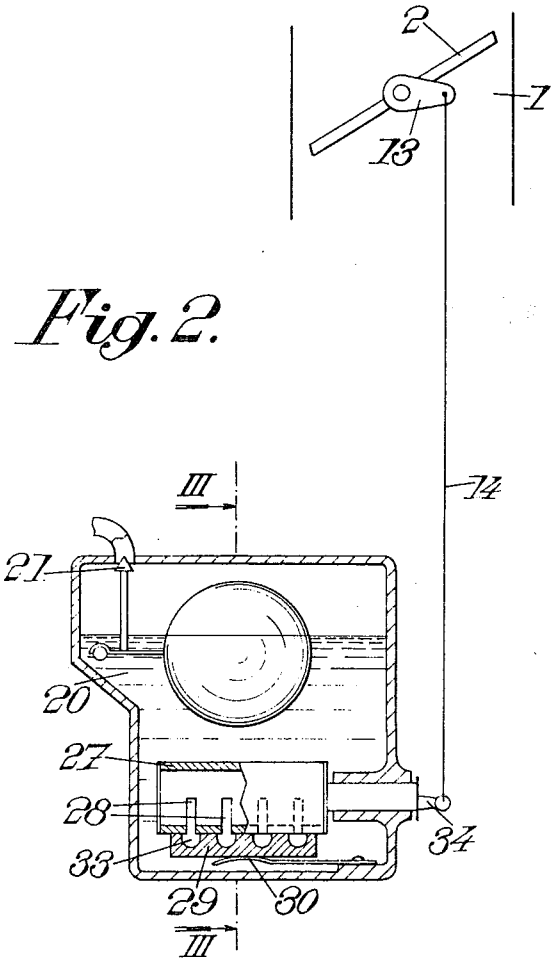

In the modified embodiment illustrated in FIGS. 2 and 3 (where, for simplicity, parts corresponding to those in FIG. 1 are denoted by the same reference numbers), the proportioning means does not comprise needles movable axially in orifices, but a rotating annular throttle member 27, the internal chamber of which is connected to float chamber 20. Circumferential slots 28 having a predetermined angular extent are formed in the side wall of the throttle member. Each slot 28 connects the interior of the throttle-chamber to chamber 33 formed in a casing 29 pressed by a spring 30 against the wall of throttle member 27. Each chamber 33 communicates with the interior of the throttle member 27 via a portion of slot 28, the length of the portion depending on the angular position of throttle-member 27, and is connected by a channel 19 to a respective branch opening into an engine cylinder. The auxiliary throttle means 2 controls the angular position of throttle-member 27 via a linkage comprising a lever 13 secured to the shaft of means 2, a rod 14 and a lever 34 secured to the throttle-member shaft. For a more complete description of the proportioning means of FIG. 2, reference may be made to French patent specification No. 74 42350.

Operation is as follows: when the main throttle means 10 is opened by the driver, the flow rate of air to the engine increases. The auxiliary throttle means 2 opens and takes a position which is representative of the air flow rate. When the auxiliary throttle means is opened, it lifts the needles 15 (FIG. 1) or rotates the throttle member 27 (FIGS. 2 and 3). Fuel is drawn from float chamber 20 by the vacuum in the supply branches of the cylinders via a metering area corresponding to the annular spaces left free by needles 15 in orifices 18, or to the portions of slots 28 which open into component 29.

Due to the head loss produced by throttle means 2 and 10, a vacuum prevails in branches 1*a*, 1*b*. That vacuum acts on the discharge orifices 23 and tends to draw the fuel unless valve member 24 is applied on its seat. The vacuum tends to be transmitted to the body of fuel in chamber 22 (FIG. 1) to reduce the pressure on diaphragm 31 and to bias valve 24 toward closure. Since however the opposite surface of diaphragm 31 is subjected to the pressure communicated by passage 25, the pressure in duct 19 and chamber 22 tends to become equal to the pressure in duct 25 (i.e., in the portion of the intake pipe 1 between means 2 and 10) for diaphragm balance. Upon equilibrium, valve 24 adjusts the flow cross-section of the discharge orifice so as to maintain the fuel downstream of orifice 18 at a pressure approximately equal to the pressure in the aforementioned portion of pipe 1. This is however subject to the assumption that spring 26 does not intervene, i.e., that it exactly balances the weight of the movable parts of the regulator. Advantageously, however, the spring is selected slightly stronger, so as to close valve 24 when the motor stops, thus avoiding the risk that at slight inclinations of the engine, the pressure exerted on diaphragm 31 will be sufficient to open one of the valves. If not, fuel would spill into the intake pipe.

For accurate metering of the air-fuel mixture, the fuel and air cross-sections are proportional; in addition air and fuel must travel through the calibration areas under the same pressure difference. The float chamber (which represents the upstream portion of the fuel calibration system) is at atmospheric pressure, i.e., at approximately the same pressure as the air inlet of the carburation system, upstream of the auxiliary throttle means 2. The pressure downstream of auxiliary throttle means 2 is communicated by passage 25 and the pressure of the fuel in ducts 19 is adjusted to the same pressure.

Consequently, the conditions for constant richness are fulfilled irrespective of the operating conditions. On the other hand, the discharge orifice section is always kept compatible with good fuel atomization and there is no air inflow sufficient to impair idling.

Figure 4:
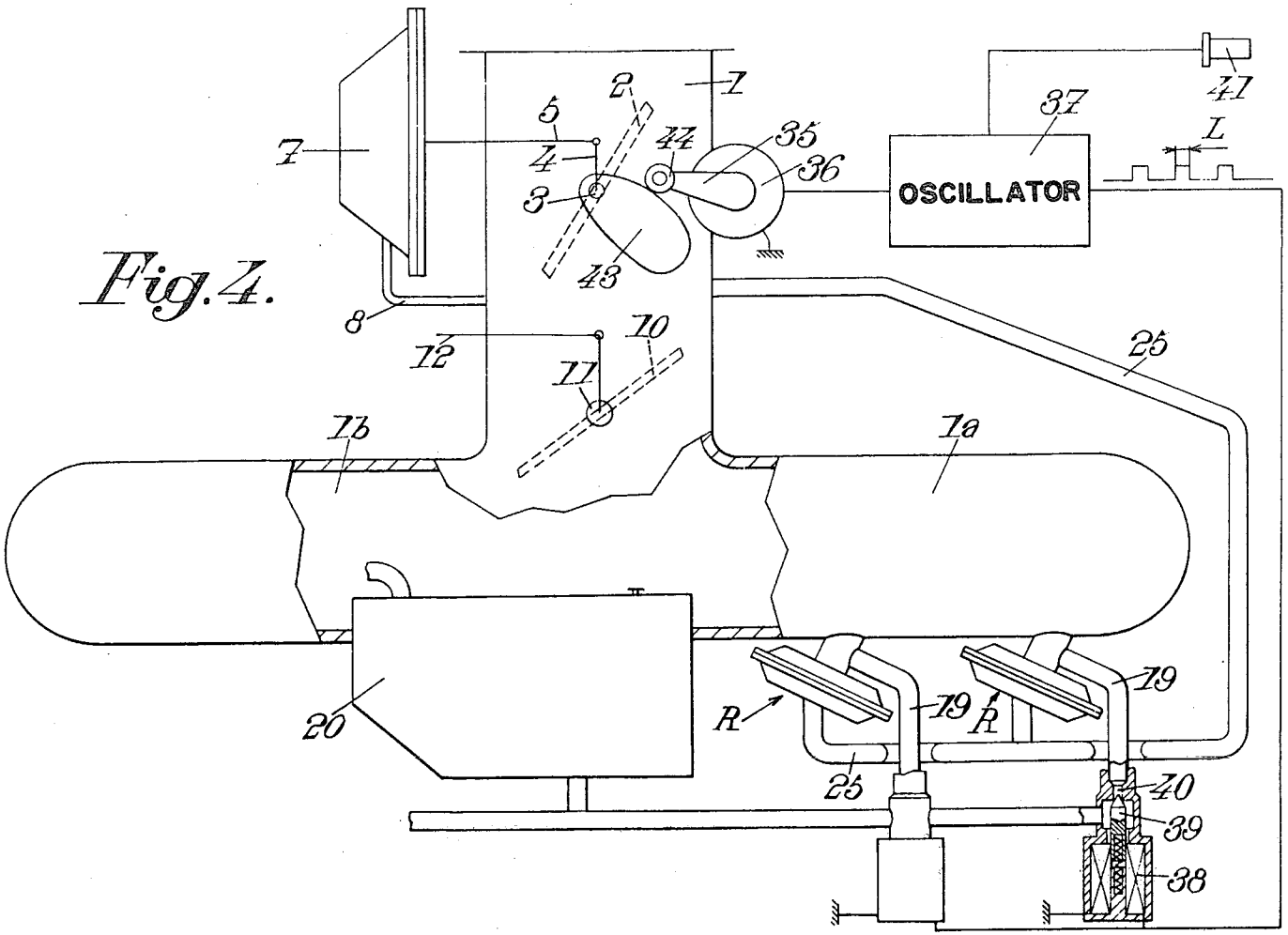

Alternatively, the proportioning means can have the construction shown in FIG. 4, where elements already already shown in FIG. 1 are denoted by the same reference numbers. The proportioning means is of the kind described in U.S. Pat. No. 3,867,913 to which reference may be made. There is provided a cam 43 actuated by the shaft 3 of throttle means 2 and cooperating with a cam follower having a roller 44 mounted on a lever 35. When lever 35 is rotated, it varies the resistance of a potentiometer 36. The resistance of potentiometer 36 constitutes an input signal of an electronic circuit 37 comprising e.g. an oscillator sending signals having a predetermined frequency but a variable duration time L to electromagnets or solenoids 38 each acting on a needle valve 39. When a solenoid is not energized, the corresponding needle closes a calibrated orifice 40 which connects the float chamber 20 to the chamber 22 of a corresponding pressure regulator R associated with one cylinder of the engine. Each signal pulse delivered to solenoids 38 opens the valves 39 and allows fuel to flow through the orifices 40. The total time during which the orifice is opened during a predetermined time period is thus dependent on the number of signals per unit time and one their length L.

In short, the flow rate of liquid per unit time depends on the position of the potentiometer slider which varies the length L at a rate determined by cam 43.

The device of FIG. 4 has the advantage of eliminating mechanical connection between the fuel-proportioning means and shaft 3 of means 2, such connection being required in FIGS. 1 and 2–3. Electromagnets 38 and valves 39 can then be placed quite close to the pressure regulators R.

Another advantage is that valves 39 block orifices 40 whenever the engine is stopped, thus avoiding possible fuel leaks.

Finally, second order corrections may easily be introduced into electronic circuit 37, since any correction factor can act either on the frequency or on the length L of the square pulse signals, thus affecting the flow rate of fuel.

Correction can be made to allow e.g. for atmospheric conditions (such as air temperature or pressure), the engine operating conditions, the composition of exhaust gases, etc. A probe or pick-up 41 is then provided as an additional input.

Figure 5:
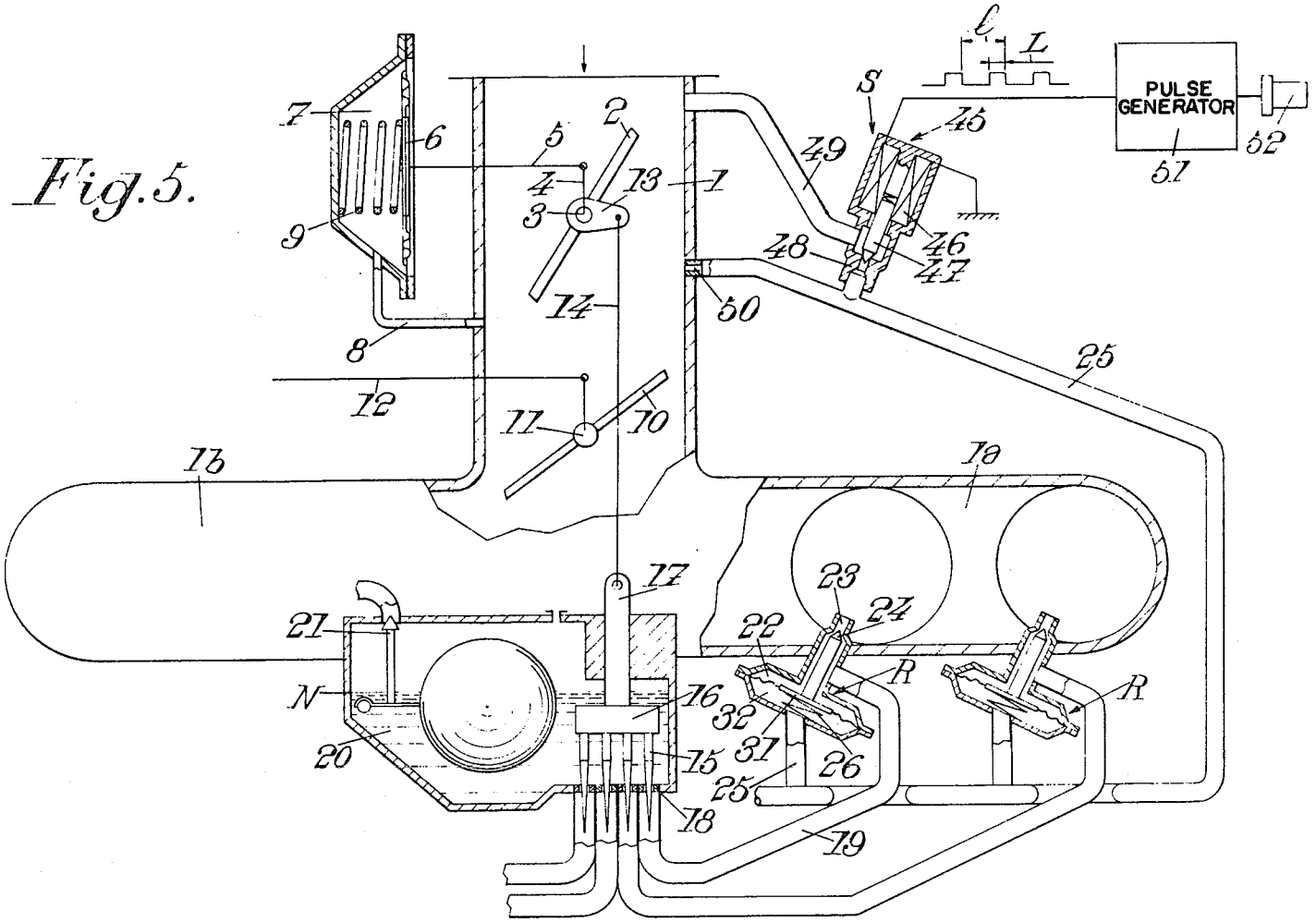
FIG. 5 is a schematic sectional elevational view of the main components of another carburation device for a four-cylinder engine.

Referring now to FIG. 5, there is shown a carburation device in which the general arrangement of parts is similar to that already described with reference to FIG. 1. Again, the corresponding parts will be designated by the same reference numerals and will not be described again.

The carburation device of FIG. 5 has fuel proportioning means and one pressure regulator R per engine cylinder. Again each regulator R receives fuel via a duct 19 from the proportioning means 18.

Each pressure regulator R comprises a casing made up of two shells which clamp the periphery of a movable diaphragm 31. In the regulator casing, diaphragm 31 separates two chambers 22 and 32. Chamber 22 communicates with duct 19 and has a discharge orifice 23 opening into the branch of the intake pipe which supplies one of the cylinders. The wall of discharge orifice 23 constitutes the seat of a valve member 24 carried by diaphragm 31. Control chamber 32 communicates via a passage 25 with the part of the induction pipe 1 disposed between means 2 and 10. A spring 26 disposed behind diaphragm 31 tends to close valve 24.

The pressure in duct 19 is controlled by the pressure transmitted to the control chamber 32 by passage 25. Any deviation of the pressure in chamber 32 with respect to the pressure in the induction pipe results in a modification in the pressure in ducts 19. Consequently, it is seen that the flow rate of fuel through the regulators R can be adjusted by modifying the pressure in chamber 32. To this end, the device of FIG. 5 additionally comprises a branch pipe 49 which opens into passage 25 via a solenoid valve S. Valve S comprises a movable spindle whose tip cooperates with a seat 48. When valve S is open, it admits additional air from branch pipe 49 into passage 25. In FIG. 5, pipe 49 is connected to induction pipe 1 upstream of the auxiliary throttle means 2. Spindle 47 is lifted from its seat upon energization of solenoid 46 against the force of a closing spring. Electric control pulses are supplied to valve S by an electronic circuit 51. In operation, circuit 51 transmits periodic rectangular current pulses whose cyclic ratio L/1 is determined by the signal delivered by a probe 52. The probe can e.g. have an electric resistance which is dependent on an engine operating parameter. Passage 25 has an inlet calibrated orifice 50 which facilitates adjustment of the regulator control pressure by means of valve S. Pipe 49 may also be provided with a calibrated orifice.

If valve S opens during a fraction L/1 of a given time (e.g. one second), some air is admitted through pipe 49 and seat 48 to passage 25, thus slightly reducing the depression in passage 25. The reduced depression is transmitted to the control chambers 32 of regulators R and similarly modifies the depression in ducts 19. When the depression is attenuated, the flow rate of fuel decreases. If then L/1 decreases, the depression increases and the fuel flow rate increases similarly. In short, the system can act on the fuel flow rate in dependence on the signal provided by pick-up probe 52, as a result of which a variation is made in the cyclic ratio L/1 of the signals (or in the length L thereof if the period 1 is constant), and consequently in the total time during which valve 47 is open for a predetermined time period.

Pick-up probe 52 can be sensitive to any one of a number of external parameters, e.g. the pressure or temperature of the air around the engine, or can be sensitive to an engine operating condition, e.g. it can be immersed in the engine exhaust gases and supply a signal in dependence on the chemical composition thereof, or detect the threshold at which an instability appears in the engine operation. A plurality of simultaneously-acting probes can be provided so that a number of parameters can be taken into account in operation.

Figure 6:
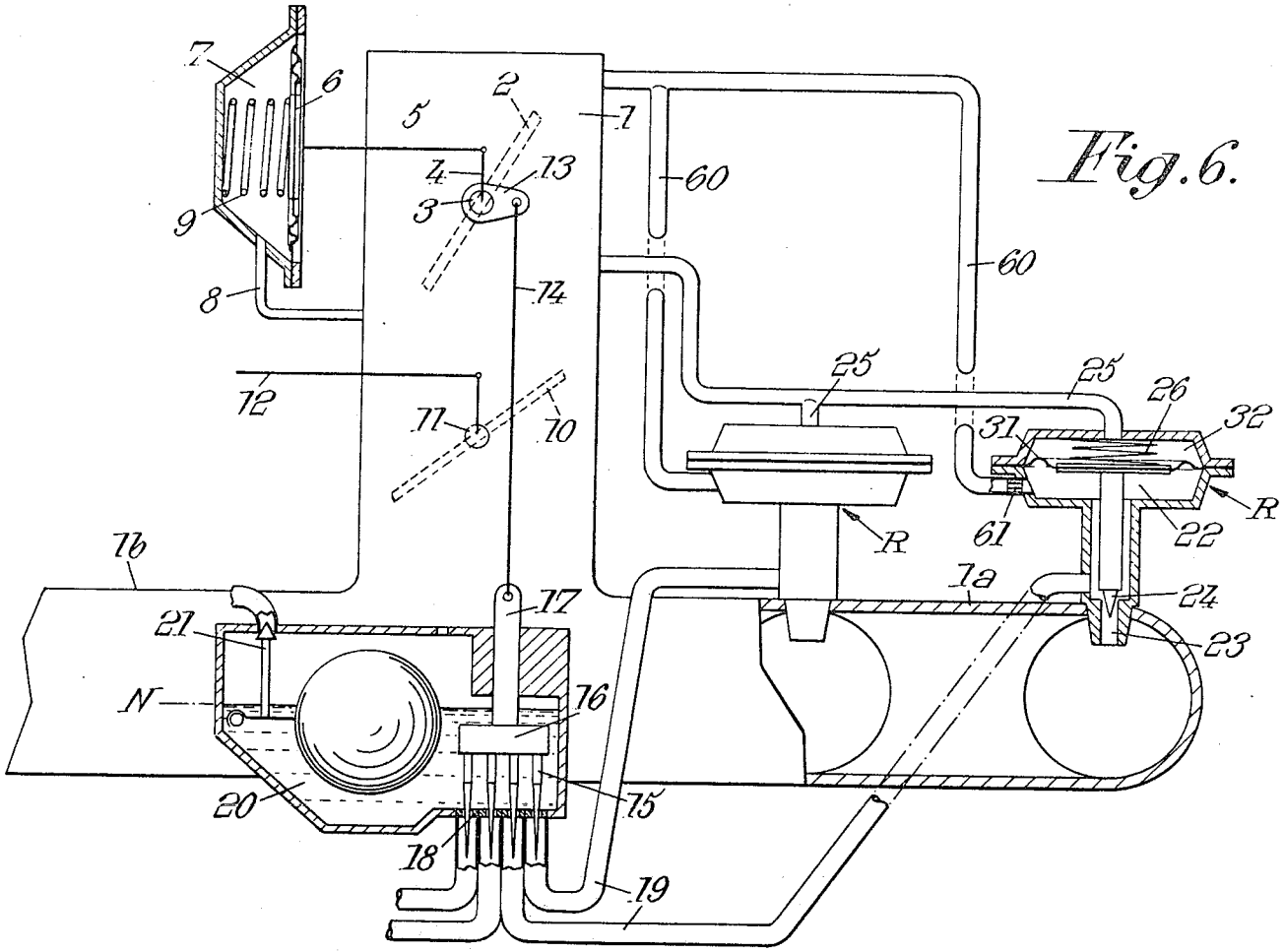
FIG. 6 is a schematic sectional elevational view of the main components of another carburation device for a four-cylinder engine.

Referring now to FIG. 6 (where parts corresponding to those in FIG. 1 are denoted by like numerals) there is shown a carburation device which again comprises fuel proportioning means having four needles 15 having a suitable cross-section variable along their length, secured to a holder 16 and movable in stationary calibrated jets or orifices 18. Holder 16 is secured to a rod 17, connected to means 2 by a rod 14 and lever 13. The cross-section available for fuel flow around needles 15 in orifices 18 varies in dependence on the position of rod 17, i.e., of the throttle means 2.

Each orifice 18 connects a float chamber 20 (in which the fuel is maintained at a constant level N) to a respective duct 19 which opens into a pressure regulator R. Each regulator R, one of which is shown in cross-section in FIG. 1, comprises a casing in which a diaphragm 31 separates two chambers 22 and 32. A passage 23, which can be closed by a valve 24 secured to the movable valve components comprising diaphragm 31, connects the bottom part of chamber 22 to a corresponding branch of the intake of the engine. Duct 19 opens into chamber 22 in the immediate neighbourhood of the seat of valve 24, at a level which is higher than level N. The top part of chamber 22 is connected by an air-supply duct 60 to pipe 1 upstream of means 2. Duct 60 has a calibrated orifice 61.

Regulator R is disposed substantially vertically so that liquid fuel is at the bottom of chamber 22 near the seat of valve 24, whereas air arrives at the top part of chamber 22 in contact with diaphragm 31.

The control chamber 32 is connected by a passage 25 to the part of the intake pipe 1 between the two throttle means 2 and 10. Passage 25 can be associated with pressure-modulating means of the kind illustrated in FIG. 5.

The device operates as described with reference to FIG. 1, except that the fuel does not fill chamber 22 and its level is only slightly above that of the tip of valve member 24, since the mouth of duct 19 is in the immediate neighbourhood of valve 24. Since fuel is discharged through passage 23 at the same rate as it arrives in chamber 22, the chamber does not contain any appreciable amount of fuel but is almost completely filled with air which arrives through duct 60 and orifice 61 and is drawn through the free space inside the seat when the valve member 24 is lifted.

Air which is sucked into the pipe has a favorable effect: it increases the speed of the fuel-air mixture around valve member 24 and improves the atomization of fuel. The depression in the intake manifold may be considerable, whereas the depression in chamber 22 is substantially equal to the pressure in the part of the intake pipe 1 between means 2 and 10. As a result of the pressure difference, air and fuel flow at a high speed through the space left free by the valve member, particularly under low engine load (when the main throttle means is only partially open).

If, when the engine is at a stop, the fuel level rises in one regulator R as a result of vehicle tilt, the fuel level rises in chamber 22 but only expels air therefrom through orifice 61 and duct 60, without acting on diaphragm 31. Consequently, valve 24 cannot be opened and fuel cannot flow into the intake manifold.

Abrupt acceleration temporarily and strongly increases the depression in passage 25 and, therefore, temporarily opens valve 24 to a considerable extent. However, the air arriving through orifice 61 continues to be sucked into the manifold at high speed, due to the difference between the depressions in the intake manifold and in chamber 22. The air drives the fuel as it arrives via duct 19, and the fuel need not flow into compartment 22 to compensate for the increase in volume resulting from the upward movement of the movable components (valve member and diaphragm). The increase in volume resulting from the upward movement is compensated by air supplied through duct 60 and not by an increase in the quantity of fuel contained in chamber 22. An abrupt increase in the flow cross-section offered by valve member 24 results in a very rapid discharge of any reserve of fuel stored upstream of valve 24. The abrupt increase in the rate of fuel supply to the engine helps accelerating the engine.

In the embodiment illustrated in FIG. 6, a fuel "jet" is introduced into each branch perpendicularly to the stream of air flowing therein. It may be advantageous to deflect the jet so that it becomes parallel to the direction of air flow, so as not to wet the manifold walls. This result is obtained in the embodiment illustrated in FIGS. 7 and 8.

In FIGS. 7 and 8, where components corresponding to those illustrated in FIG. 6 bear the same reference numbers, passage 23 opens into a tubular element 62 disposed coaxially with the manifold branch. The mouth of passage 23 is so located that fuel sucked into the manifold is directed parallel to the direction f of the main air flow and the walls are not wetted. More particularly, if the assembly comprising the pressure regulator R and the tubular element 62 are disposed near the intake valve 24, the fuel does not appreciably wet the walls during operation. The device operates with a dry manifold, which is an advantage during cold operation, when contact between the fuel and the walls may produce abundant condensation, and is also an advantage during transient conditions, since excess fuel is not sprayed on the walls.

For maximum efficiency of the device, the downstream valve of the tubular element 62 is placed at the throat of a venturi 63, through which air travels at maximum speed. As a result, the fuel coming out of passage 22 is driven faster and more completely atomized.

Referring to FIG. 9, there is shown proportioning means which may be used in the system of FIG. 1. The body of the carburation device is formed with an induction pipe 1 in which there is located auxiliary throttle means 2 (consisting of a balanced flap carried by a rotatable shaft 3) and main throttle means 10 controlled by the driver via a linkage 12.

The proportioning means constitutes an assembly which is partially immersed in the fuel contained in float chamber 20. The proportioning means comprises a stationary casing 70 formed with two pairs of passages 86 and 87 each of which feeds a fuel pressure regulator (not shown). Two tubular parts each associated with two passages 86, 87 are located in corresponding bores formed in casing 70. A cylindrical rod 76 is slidably received in each tubular part. The lower end surface of each rod 76 is angularly directed with respect to the axis of the rod and the higher end surface is in abutment against an adjustable screw 78 carried by a bell crank lever 79 carried by a pivot 81. The end of the lever which is opposite to the end portion which carries the screws 78 is provided with a roller 82 which cooperates with a cam 83 secured to shaft 3 and consequently non-rotatably connected with the flap 2.

A spring 74 continuously biases each rod 76 upwardly. Spring 74 is carried by the end wall of a plug 73 threadedly received in casing 70 and formed with an orifice for fuel flow toward the portion of the tubular part under the rod 76. A clamp 77 is frictionally retained on the higher portion of each rod 76 and is formed with a loop slidably received in a longitudinal slot 88 of the casing (FIG. 11). The frictional force exerted by the clamp on the rod is sufficient for preventing accidental rotation of the rod. However, the rod 76 may be manually rotated in clamp 77. For that purpose, two flats 85 are formed on the upper portion of the rod.

A spring 84 is provided for maintaining the roller 82 in contact with cam 83. Consequently, the roller 82 is a cam follower and the bell crank lever 79 as well as the screws 78 have a position which is determined by the amount of opening of flap 2. The shape of cam 83 is so selected that the effective area of a traversing slot 75 which is uncovered by rod 76 is proportioned to the airflow in the passage left free by flap 2.

In the embodiment of FIGS. 9–13, each tubular part consists of two tubes 71 and 72 in end-to-end relation. The slot 75 is formed by a notch formed with a suitable machining tool on the upper end surface of tube 72. A passage 86 or 87 opens into the bore of the casing at a location opposite the slot. Consequently, the fuel which flows through the slot is conveyed by the passage to a corresponding manifold branch. Since the lower end surface of rod 76 is angularly located with respect to the axis, any axial movement of rod 76 modifies the effective cross-sectional area of the slot available for fuel flow.

If the two slots are formed using the same machining tool which traverses the tube 72, the slots are identical. Any angular error when locating the rod 76 may be cured by moving the rod 75 angularly, using a tool acting on the two flats 85. Consequently, the flow rates in the two slots 75 can easily be balanced.

If a four-cylinder engine is used, two identical devices each controlled by a separate screw 78 may be used. The flow rates in the two passages 86 and 87 of a same pair are first balanced. Then the flow rates in the two pairs are balanced using the screws 78.

The above description makes it apparent that the flow rates in several passages 86 and 87 may be controlled by a single actuating system (cam 83 and roller 82) while it remains possible to adjust the flow rate in each passage.

Modified embodiments are possible. For instance, each slot 75 may consist of a notch in either the lower tube 72 or the upper tube 71 and may be of tapered form, as illustrated on FIG. 12. Slot 75 may as well be formed in the higher tube 71 only or both tubes. The shape of slot 75 may be other than triangular.

I claim:

1. In a carburation device for an internal combustion engine comprising, in an induction pipe, driver actuatable main throttle means, auxiliary throttle means which is located upstream of said main throttle means and which opens automatically and progressively in proportion to the increase in the flow rate of air through the induction pipe, a fuel source, channel means connecting said source and a fuel discharge orifice through which fuel is drawn into the induction pipe downstream of the main throttle means, and fuel proportioning means controlled by said auxiliary throttle means and metering a fuel flow control cross-sectional area in said channel means upstream of said fuel discharge orifice, a fuel pressure regulator located on said channel means between the fuel proportioning means and the discharge orifice, having movable means subjected to opposite forces exerted by the air pressure in a control chamber of the regulator, said control chamber being connected by an air line with the portion of said induction pipe between the main throttle means and the auxiliary throttle means, and by the fuel pressure, whereby the pressure of the fuel discharged into the induction pipe is adjusted automatically at a value which is in direct relation with said air pressure.

2. A carburation device according to claim 1, wherein in operation the regulator adjusts the fuel pressure at a value substantially equal to the air pressure between the throttle means.

3. A carburation device according to claim 1, comprising one proportioning means and one pressure regulator per engine cylinder.

4. A device according to claim 1, wherein the proportioning means is controlled by solenoid means and is in the immediate neighbourhood of the corresponding pressure regulator.

5. A carburation device according to claim 1, wherein the control chamber is operatively associated with modulating means for automatically varying the air pressure therein in dependence on at least one engine operating parameter.

6. A carburation device according to claim 5, wherein the pressure regulator comprises a valve having a valve seat and a valve closure member actuated by a diaphragm, one surface of which bounds a second chamber which is connected to the outlet of the fuel proportioning means and through which the sucked fuel flows, whereas the other surface of the diaphragm bounds said control chamber.

7. A carburation device according to claim 5, wherein the modulating means comprises a solenoid valve for controlling communication between atmospheric pressure and a duct connecting the control chamber to the portion of the intake pipe between the auxiliary and main throttle means, and further comprises means which, in response to the operating parameter, repetitively supplies the solenoid with electric energizing pulses at a sufficient high frequency to prevent pressure oscillations at the same frequency in the control chamber.

8. A device according to claim 7, wherein the duct is continuously connected to the induction pipe by a calibrated orifice.

9. A device according to claim 5, wherein the operating parameter is independent of modifications in the flow rate of fuel into the engine.

10. A device according to claim 5, wherein the operating parameter is the composition of the exhaust gases of the engine.

11. A carburation device according to claim 1, wherein the fuel is supplied to the pressure regulator in the immediate neighbourhood of an outlet valve of the regulator and the chamber receiving the fuel before it travels through the outlet valve is supplied with air through a calibrated orifice.

12. A device according to claim 11, wherein the regulator chamber receiving the fuel is supplied with air from a source at approximately atmospheric pressure.

13. A device according to claim 11, wherein the pressure regulator comprises a diaphragm, one surface of which bounds the control chamber whereas the other surface bounds the chamber receiving the fuel.

14. A device according to claim 13, wherein the chamber receiving the fuel is supplied with air in the immediate neighbourhood of the diaphragm.

15. A device according to claim 13, wherein the regulator is disposed substantially vertically, the discharge orifice controlled by the outlet valve being located to direct fuel downwardly, fuel being supplied immediately above the valve and air being supplied at the top of the chamber bounded by the discharge orifice and the diaphragm which is sensitive to the depression between the throttle means.

16. A carburation device according to claim 1, wherein said proportioning means comprises at least one tubular part whose wall is formed with a slot at an angle with respect to the axis of the tubular part and a metering rod operatively connected to said auxiliary throttle means for movement thereby along the axis of said tubular part, said rod having an end surface which is at an angle with respect to said axis and in operation closes a fraction of said slot which depends on the axial position of said rod with respect to said tubular part.

17. A carburation device according to claim 16, wherein said tubular part consists of two tubes located in end-to-end relation, the end portion of one at least of said tubes in contact with the other tube being machined.

18. A carburation device according to claim 16, wherein said tubular part is provided with two identical slots cooperating with the same rod and each feeding one of the cylinders of the engine.

19. A carburation device according to claim 18, wherein said rod is angularly adjustable around the axis of said tubular part for balancing the flow rate in the two slots.

20. A carburation device according to claim 1, wherein said fuel source is a float chamber.

21. In a carburation device for an internal combustion engine comprising, in an induction pipe, driver actuatable main throttle means, auxiliary throttle means which is located upstream of said main throttle means and which opens automatically and progressively in proportion to the increase in the flow rate of air through the induction pipe, a fuel source, channel means connecting said source and a fuel discharge orifice through which fuel is drawn into the induction pipe downstream of the main throttle means, and fuel proportioning means controlled by said auxiliary throttle means and metering a fuel flow control cross-sectional area in said channel means upstream of said fuel discharge orifice, a fuel pressure regulator having:

a valve member movable to and from a seat limiting a passage in said channel means between said fuel proportioning means and said discharge orifice, movable wall means operatively connected to said valve member, said movable wall means having a face subjected to the pressure of the fuel in said channel means upstream of said passage, which pressure biasing said valve member away from its seat, and another face limiting a control chamber, the pressure in said control chamber biasing said valve member toward its seat, and air line means connecting said control chamber with the portion of the induction pipe between the throttle means.

* * * * *